US011730334B2

(12) United States Patent
Zhou

(10) Patent No.: US 11,730,334 B2
(45) Date of Patent: Aug. 22, 2023

(54) CLEANING APPARATUS FOR CLEANER ROBOT

(71) Applicant: Shenzhen Tecbot Intelligent Robot Co.,Ltd., Shenzhen (CN)

(72) Inventor: Shengfang Zhou, Huaihua (CN)

(73) Assignee: SHENZHEN TECBOT INTELLIGENT ROBOT CO., LTD., Shenzhen (CN)

( * ) Notice: Subject to any disclaimer, the term of this patent is extended or adjusted under 35 U.S.C. 154(b) by 146 days.

(21) Appl. No.: 17/117,503

(22) Filed: Dec. 10, 2020

(65) Prior Publication Data

US 2021/0393101 A1 Dec. 23, 2021

(30) Foreign Application Priority Data

Jun. 17, 2020 (CN) ..... 202010555359.0

(51) Int. Cl.

| | |
|---|---|
| ***A47L 11/40*** | (2006.01) |
| ***A47L 11/30*** | (2006.01) |
| ***A47L 13/08*** | (2006.01) |
| ***A47L 13/16*** | (2006.01) |

(52) U.S. Cl.

CPC ..... *A47L 11/4041* (2013.01); *A47L 11/302* (2013.01); *A47L 11/4016* (2013.01); *A47L 11/4069* (2013.01); *A47L 11/4088* (2013.01); *A47L 13/08* (2013.01); *A47L 13/16* (2013.01); *A47L 2201/00* (2013.01)

(58) Field of Classification Search

CPC ..... A47L 11/4016; A47L 11/4083; A47L 11/4088; A47L 11/302; A47L 11/34; A47L 11/38; A47L 11/305; A47L 11/325

See application file for complete search history.

(56) References Cited

U.S. PATENT DOCUMENTS

2021/0106197 A1* 4/2021 Yan ..... A47L 11/4088

FOREIGN PATENT DOCUMENTS

CN 209750931 U 12/2019
CN 111150339 A * 5/2020

OTHER PUBLICATIONS

CN-111150339-A—translation (Year: 2022).*

* cited by examiner

*Primary Examiner* — Brian D Keller
*Assistant Examiner* — Sarah Akyaa Fordjour
(74) *Attorney, Agent, or Firm* — WPAT, PC

(57) ABSTRACT

A cleaning apparatus for a cleaner robot is provided and includes a main body. An accommodation cavity is formed inside the main body. The cleaning apparatus further includes a water spraying device and a sweeping roller, the water spraying device is disposed in the accommodation cavity and detachably connected with the accommodation cavity, and the sweeping roller is disposed in the accommodation cavity and detachably connected with the accommodation cavity. A water squeezing rod is arranged between the sweeping roller and the accommodation cavity. The main body is further disposed with a sewage recovery device detachably connected therewith. The sewage recovery device includes a sewage sink disposed at an inner side of the sweeping roller, and the sewage sink abuts against the inner side. The main body is further disposed with a driving device for driving the sweeping roller to rotate.

17 Claims, 5 Drawing Sheets

CLEANING APPARATUS FOR CLEANER ROBOT

TECHNICAL FIELD

The invention relates to the technical field of cleaner robots, and more particularly to a cleaning device for a cleaner robot.

DESCRIPTION OF RELATED ART

At present, most of cleaner robots on the market each are with a cotton rag on the bottom of the cleaner robot, and a water tank is installed above the rag. As it is working, the water tank drips water on the rag. When the cleaner robot works, the rag is driven to move in the room, and because the rag touches the floor, it achieves the function of cleaning the floor.

However, such mechanism has the following main problems that: 1). because the rag does not have the function of automatic cleaning, the rag is easy to get dirty after a few minutes of work and needs to be removed for manual cleaning, and thus it will cause secondary pollution to the room if continuing to work without cleaning; 2). drip of water is uncontrolled, water is still dripped even if it is not needed, which will damage or contaminate the floor of the room; and 3). since the rag does not have the function of automatic cleaning, it needs to be removed and washed frequently by the user in the actual use process, which seriously reduces the practicality of smart cleaner robot.

A Chinese patent application No. 201822239297.3 (with a patent granted No. CN209750931U), filed on Dec. 28, 2018, published on Dec. 10, 2019, and entitled "floor sweeping roller apparatus and cleaner robot", discloses a floor sweeping roller apparatus and a cleaner robot. The floor sweeping roller apparatus includes a shell, a sweeping roller, a connection assembly and a driving mechanism. The shell is provided with an accommodation cavity, the sweeping roller is arranged in the accommodation cavity, two ends of the sweeping roller are engaged with the connection assembly in an insertion manner, and the driving mechanism is connected with the connection assembly to drive the sweeping roller to rotate. As to the floor sweeping roller apparatus and the cleaner robot as disclosed, the sweeping roller is installed in the accommodation cavity of the shell by engaging with the connection assembly in the insertion manner, and the driving mechanism is connected with the connection assembly, so that the sweeping roller can be stably driven to rotate, and a cleaning effect of the cleaner robot is achieved. Due to the fact that the sweeping roller and the connection assembly are engaged in the insertion manner to achieve connection and fixation, so that during assembling, only the two ends of the sweeping roller need to be inserted into the connection assembly, and during disassembling, the sweeping roller can be taken out easily, the disassembling and assembling are very convenient, the working efficiency of sweeping roller replacement is improved, and the user experience of the cleaner robot is good.

The above patent document discloses a type of floor sweeping roller apparatus and a cleaner robot, but its component for cleaning is too simple in function and not reusable for cleaning, so that it is inconvenient to use and cannot satisfy the needs of consumers.

SUMMARY

Accordingly, a primary objective of the invention is to provide a cleaning apparatus for a cleaner robot, which is more convenient to realize a cleaning function, reusable for cleaning and capable of recovering sewage.

In order to achieve the above objective, an embodiment of the invention provides a cleaning apparatus for a cleaner robot. The cleaning apparatus includes a main body, and an accommodation cavity is formed inside the main body. The cleaning apparatus includes a water spraying device and a sweeping roller. The water spraying device is disposed in the accommodation cavity, and the water spraying device is detachably connected with the accommodation cavity. The sweeping roller is disposed in the accommodation cavity, and the sweeping roller is detachably connected with the accommodation cavity. The water spraying device includes a water spraying pipe, and the water spraying pipe faces towards the sweeping roller.

A water squeezing rod is arranged between the sweeping roller and the accommodation cavity. The water squeezing rod is detachably connected with the accommodation cavity, and the water squeezing rod abuts against the sweeping roller. The main body is further disposed with a sewage recovery device, and the sewage recovery device is detachably connected with the main body.

The sewage recovery device includes a sewage sink, the sewage sink is disposed at an inner side of the sweeping roller, and the sewage sink abuts against the inner side of the sweeping roller.

The main body is further disposed with a driving device for driving the sweeping roller to rotate.

In an embodiment, the water spraying device includes a first water pump and a connection water pipe, the connection water pipe is disposed in the accommodation cavity, the first water pump is disposed on the main body, and the first water pump is connected to the water spraying pipe through the connection water pipe.

In an embodiment, the sweeping roller is disposed with a rag capable of absorbing or storing water.

In an embodiment, a scraping device is disposed between the water spraying device and the sweeping roller, the scraping device is disposed in the accommodation cavity, and the scraping device abuts against the sweeping roller.

In a preferred embodiment, the scraping device is a scraping plate with a comb-shaped structure.

In an embodiment, the sewage recovery device further includes a sewage tank, the sewage sink is disposed with a second water pump and a second connection water pipe, the sewage tank is detachably connected with the sewage sink, and the second water pump is connected to the sewage sink through the second connection water pipe.

In an embodiment, the main body is formed with a snapping groove corresponding to the sewage sink in size and shape, a part of the sewage sink is snapped into the snapping groove, and another part of the sewage sink is snapped into the sewage tank.

In an embodiment, the driving device includes a motor gear box, and the motor gear box is connected with the sweeping roller.

In an embodiment, a lateral side of the main body is formed with a through hole, the motor gear box includes a motor, a receiving groove corresponding to the motor in size is disposed at a side of the water spraying device, the motor is disposed in the receiving groove, and the motor gear box is connected to the sweeping roller by the through hole.

The technical solutions as proposed by the embodiments of the invention may have following beneficial effects that: 1) it squeezes the sweeping roller by the water squeezing rod, and the sweeping roller rotates under the transmission of the motor gear box, when the sweeping roller rotates and passes through the squeezing water rod, the water stored in the rag of the sweeping roller is squeezed out and downwardly flows into the sewage sink, and meanwhile water is continuously sprayed onto the sweeping roller through the water spraying device for cleaning, so that the cleaner robot has a better cleaning effect and realizes a reusable cleaning function, the service life of the cleaning apparatus is prolonged consequently; 2) as to the sewage recovery device, a water-recovering treatment method is employed to successfully solve the problem of how to recover the sewage generated during sweeping the floor, the sewage is recovered to the sewage tank on the cleaner robot, which successfully solves the problem of recovering the sewage generated during sweeping the floor; and 3) it solves the problem of collecting particle garbage, dust and sewage generated during sweeping the floor, and the article garbage, dust and sewage are collected to relevant sewage sink and sewage tank, so as to achieve the function of automatically cleaning the rag, it does not need to manually clean the rag, compared with the prior art that the rag needs to be cleaned once when it is used once, the rag will be cleaned once after being used 10 times or longer, which greatly saves the user's time.

BRIEF DESCRIPTION OF THE DRAWINGS

In order to more clearly illustrate technical solutions of embodiments of the disclosure, drawings used in the description of the embodiments will be briefly described below. Apparently, the drawings described below are merely some embodiments of the disclosure, and those skilled in the art can obtain other drawings based on these drawings without creative efforts.

DESCRIPTION OF NUMERICAL REFERENCES IN DRAWINGS

Figure 1:
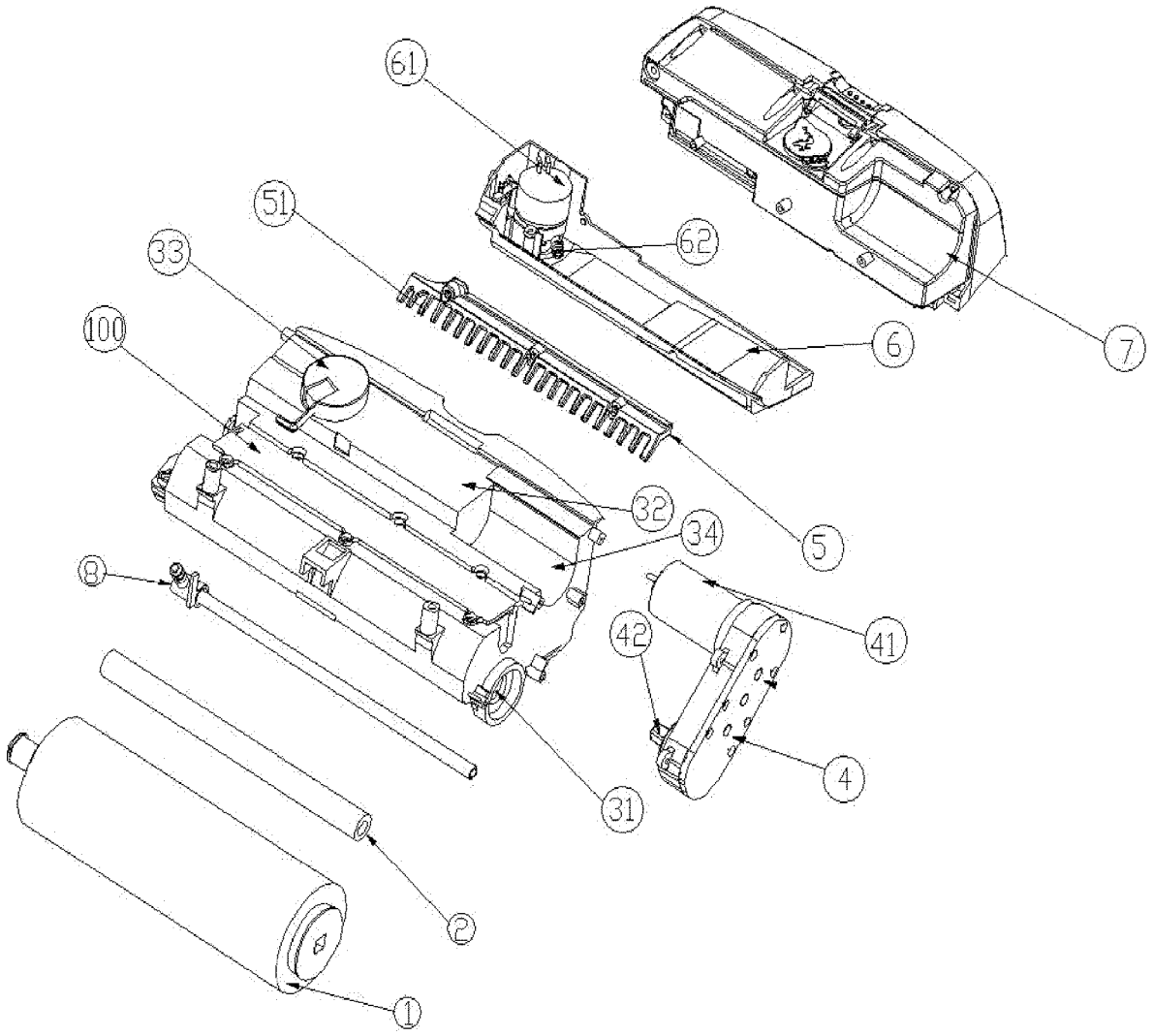
FIG. 1 is a schematic exploded structural view of a cleaning apparatus for a cleaner robot according to an embodiment of the invention.

| Numerical reference | description | Numerical reference | description |
|---|---|---|---|
| 100 | Cleaning apparatus | 42 | Bump transmission shaft |
| 1 | Sweeping roller | 5 | Scraping device |
| 11 | Transmission shaft of sweeping roller | 51 | Comb-shaped scraping plate |
| 2 | Water squeezing rod | 6 | Sewage sink |
| 3 | Main body | 61 | Second water pump |
| 31 | Through hole | 62 | Second connection water pipe |
| 32 | Water spraying device | 7 | Sewage tank |
| 33 | First water pump | 71 | Sewage tank snapping groove |
| 34 | Receiving groove | 8 | Connection water pipe |
| 35 | Accommodation cavity | 9 | Water spraying pipe |
| 36 | Snapping groove | 4 | Motor gear box |
| 41 | Motor | | |

The realization of objective, functional features and advantages of the invention will be further described in combination with embodiments with reference to accompanying drawings.

DETAILED DESCRIPTION OF EMBODIMENTS

The technical solutions in the embodiments of the invention will be clearly and completely described below, with reference to the accompanying drawings in the embodiments of the invention. Apparently, the described embodiments are merely some of the embodiments of the invention, not all embodiments. Based on the described embodiments of the invention, all other embodiments obtained by those skilled in the art without any creativity should belong to the protective scope of the invention.

It is noted that, in the embodiments of the invention, all directional indications (such as "upper", "lower", "left", "right", "front", "rear", . . . ) are merely for indicating relative positional relationships and motions among various components under certain specific postures (as shown in the drawings), if the specific postures change, the directional indication will change accordingly.

In the description of the invention, unless otherwise clearly stated and limited, terms "connected", "fixed" and so on should be understood broadly. For instance, "fixed" can be a fixed connection, a detachable connection or an integral connection; can be a mechanical connection, can also be an electrical connection; can be a direct connection, can also be an indirect connection by an intermediary, can be an internal communication of two elements or an interaction between two elements, unless otherwise clearly defined. A person skilled in the art can understand concrete meanings of the terms in the invention as per specific circumstances.

Moreover, terms such as "first" and "second" are merely for the purpose of illustration and cannot be understood as indicating or implying the relative importance or implicitly indicating the number of the technical feature. Therefore, features defined by "first" and "second" can explicitly or implicitly include one or more the features. In the description of the invention. In addition, the technical solutions of various embodiments may be combined together, any combination must be based on what can be achieved by the ordinary skilled person in the art. When a combination of technical solutions is contradictory or unable to be realized, it should be considered that such the combination of technical solutions does not exist and is not within the protection scope of the invention.

The invention provides a cleaning apparatus for a cleaner robot.

Referring to FIG. 1 through FIG. 6, in an embodiment of the invention, the cleaning apparatus 100 for a cleaner robot includes a main body 3, and an accommodation cavity 35 is formed inside the main body 3. The cleaning apparatus 100 includes a water spraying device (may also be referred to as water sprayer) 32 and a sweeping roller 1. The water spraying device 32 is disposed in the accommodation cavity 35, and the water spraying device 32 is detachably connected with the accommodation cavity 35. The sweeping roller 1 is disposed in the accommodation cavity 35, and the sweeping roller 1 is detachably connected with the accommodation cavity 35. The water spraying device 32 includes a water spraying pipe 9, and the water spraying pipe 9 faces towards the sweeping roller 1.

A water squeezing rod 2 is arranged between the sweeping roller 1 and the accommodation cavity 35. The water squeezing rod 2 is detachably connected with the accommodation cavity 35. The water squeezing rod 2 abuts against the sweeping roller 1. The main body 3 is further disposed with a sewage recovery device (may also be referred to as sewage collector), and the sewage recovery device is detachably connected with the main body 3.

The sewage recovery device includes a sewage sink 6. The sewage sink 6 is disposed at an inner side of the sweeping roller 1, and the sewage sink 6 abuts against the inner side of the sweeping roller 1.

The main body 3 is further disposed with a driving device (may also be referred to as driver) for driving the sweeping roller 1 to rotate.

In the embodiment, preferably, the sweeping roller 1 is provided with a transmission shaft 11.

In the embodiment, preferably, the sweeping roller 1 is provided with a rag capable of absorbing or storing water. The rag includes a cotton cloth with strong water absorption and water storage capacity, or a sponge-like mop.

In the embodiment, the water spraying device 32 exemplarily includes a first water pump 33 and a connection water pipe 8. The first water pipe 33 is disposed on the main body 3, and the first water pump 33 is connected to the water spraying pipe 9 through the connection water pipe 8.

The water spraying device 32 of the embodiment of the invention makes use of the first water pump 33 connected to the water spraying pipe 9 through the connection water pipe 8 to pump clear water, and the clear water can be evenly sprayed onto the sweeping roller 1 or the rag of the sweeping roller 1.

In the illustrated embodiment of the invention, joint parts shall be sealed without water leakage, when water spraying is needed, the first water pump 33 is controlled to spray water, and the sweeping roller 1 will rotate anticlockwise during cleaning the rag.

In the embodiment, when the sweeping roller 1 rotates anticlockwise and passes through the water squeezing rod 2, the water squeezing rod 2 squeezes the cotton cloth or sponge-like mop on the sweeping roller 1, the water in the rag of the sweeping roller 1 is squeezed out, and the water being squeezed out flows downwardly into the sewage sink 6.

Preferably, the sweeping roller 1 is provided with the rag, the water squeezing rod 2 squeezes the rag on the sweeping roller 1, and the water in the rag of the sweeping roller 1 is then squeezed out.

In the embodiment, the driving device exemplarily includes a motor gear box 4, and the motor gear box 4 is connected with the sweeping roller 1.

Preferably, a lateral side of the main body 3 is formed with a through hole 31, the motor gear box 4 includes a motor 41. A receiving groove 34 corresponding to the motor 41 in size is disposed at a side of the water spraying device 32, and the motor 41 is arranged in the receiving groove 34. The motor gear box 4 is further disposed with a bump transmission shaft 42, and the bump transmission shaft 42 passes through the through hole 31 and connects to the transmission shaft 11 of the sweeping roller 1. The motor gear box 4 is for driving the sweeping roller 1 to rotate.

In the embodiment, the motor gear box 4 drives the sweeping roller 1 to rotate anticlockwise, and in the process of rotation, the rag of the sweeping roller 1 is kept at a state of the floor-contacted portion thereof being squeezed for 2-3 millimeters, so as to ensure that the rag has certain friction with the floor, and thereby ensuring the effect of cleaning the floor.

In another embodiment of the invention, there is a scraping device (may also be referred to as scraper) 5 disposed between the water spraying device 32 and the sweeping roller 1. The scraping device 5 is disposed in the accommodation cavity 35, and the scraping device 5 abuts against the sweeping roller 1.

Preferably, the scraping device 5 is a scraping plate 51 with a comb-shaped structure. The scraping plate 51 abuts against the sweeping roller 1, which is convenient for cleaning dirt on the sweeping roller 1.

Preferably, the scraping plate 51 and the rag on the sweeping roller 1 make a relative movement so as to clean up sundries and garbage from the rag.

In the embodiment, the sewage recovery device includes the sewage sink 6 and a sewage tank 7. The sewage sink 6 is disposed with a second water pump 61 and a second connection water pipe 62. The sewage tank 7 and the sewage sink 6 are detachably connected with each other. The second water pump 61 is connected to the sewage sink 6 through the second connection water pipe 62.

Figure 2:
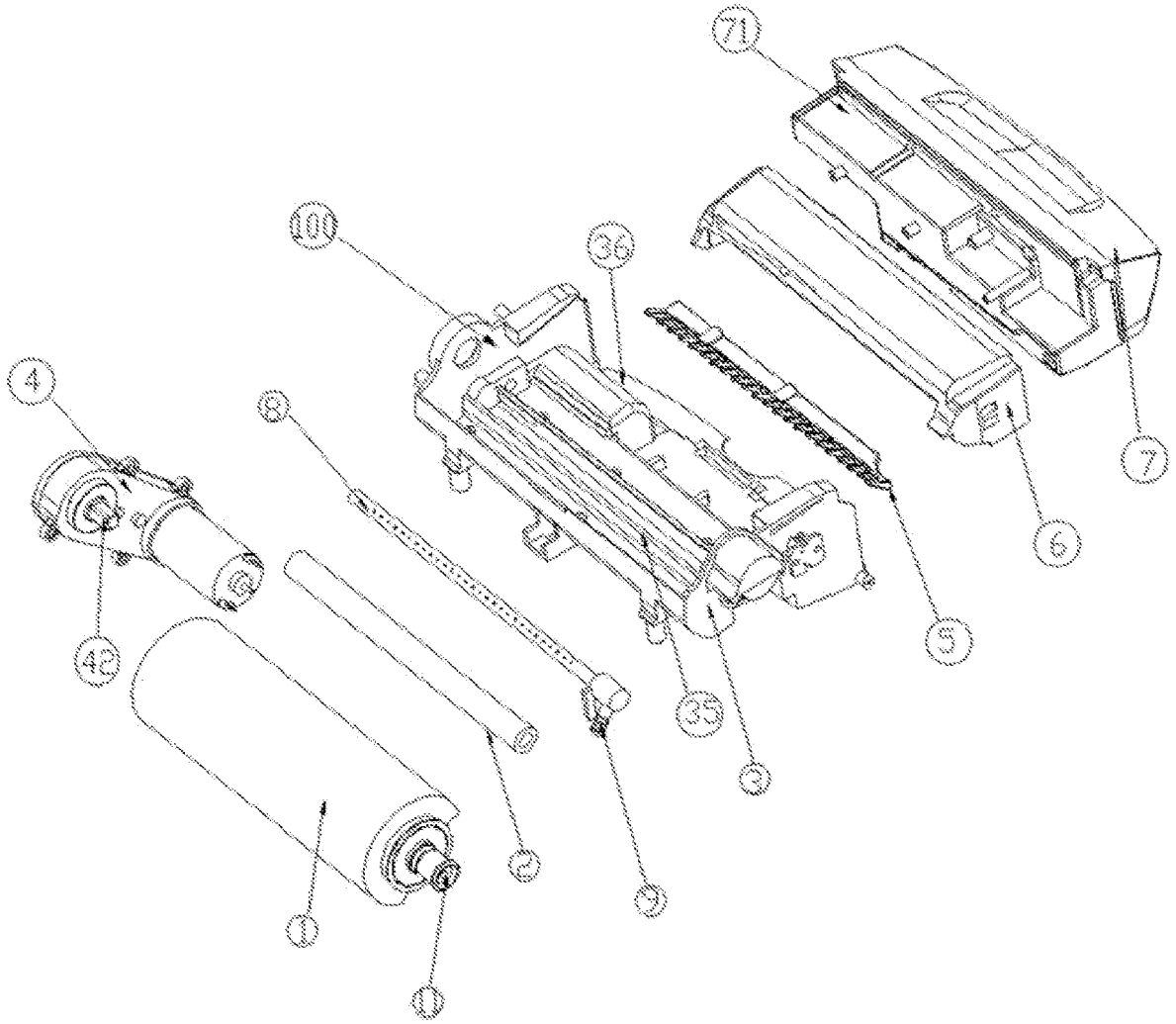
FIG. 2 is a schematic exploded structural view of a cleaning apparatus for a cleaner robot according to another embodiment of the invention.
Figure 3:
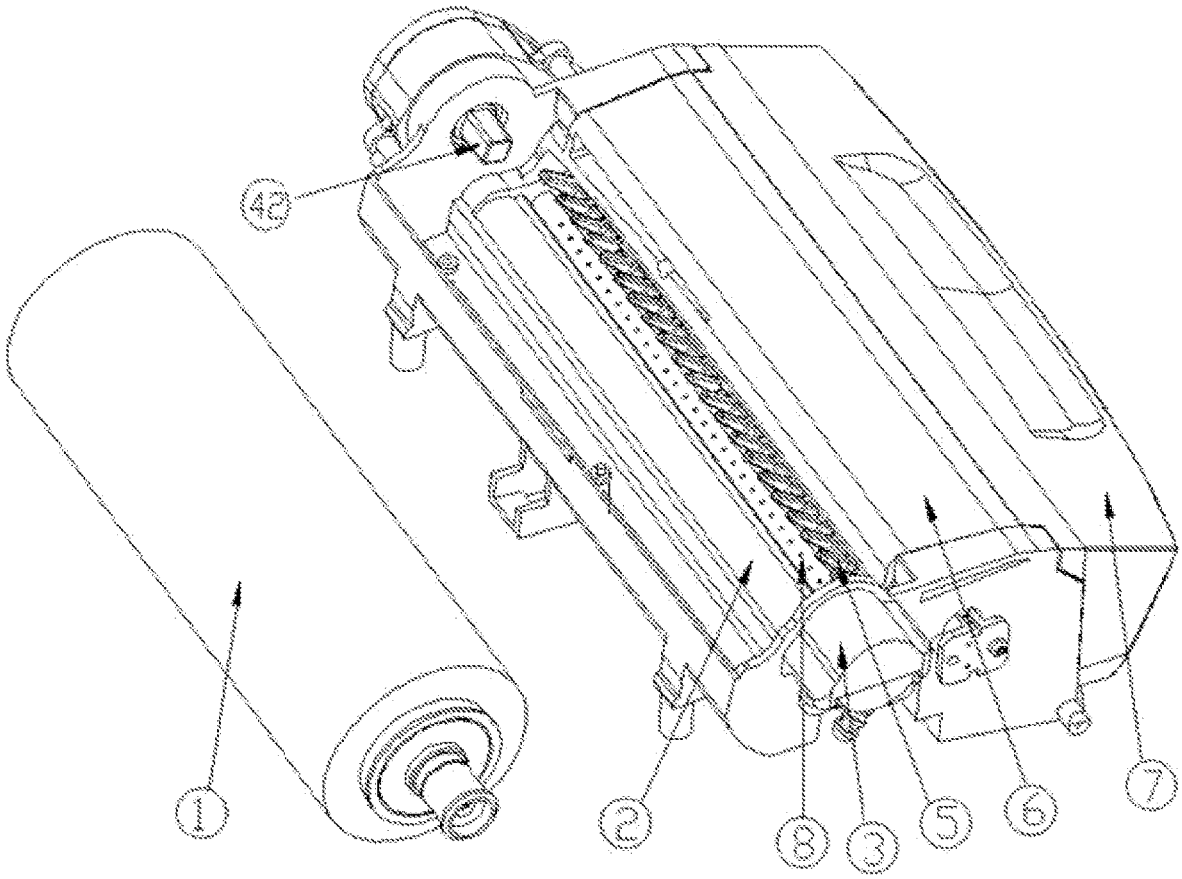
FIG. 3 is a schematic exploded structural view of a cleaning apparatus for a cleaner robot according to still another embodiment of the invention.
Figure 4:
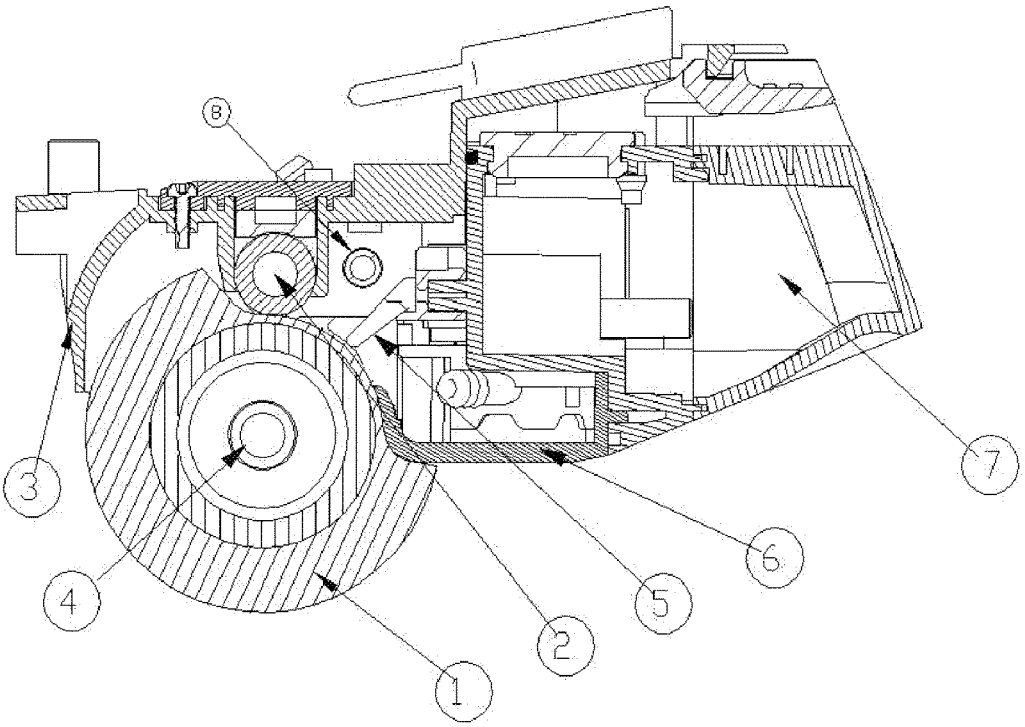
FIG. 4 is a schematic cross-sectional view of a cleaning apparatus for a cleaner robot according to an embodiment of the invention.
Figure 5:
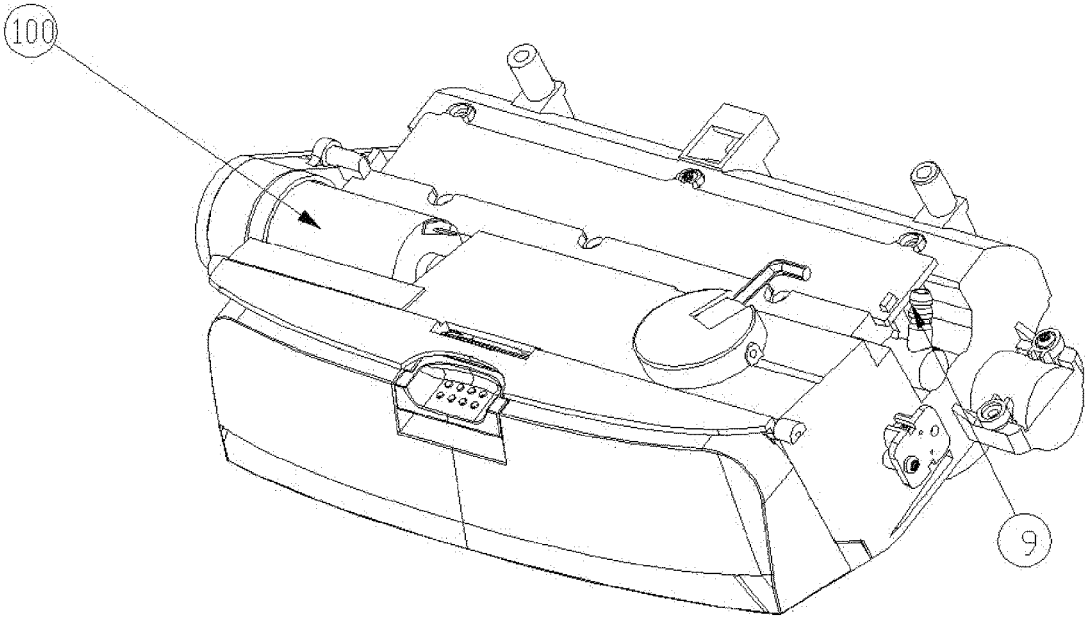
FIG. 5 is a schematic perspective structural view from the rear side of the cleaning apparatus for a cleaner robot according to an embodiment of the invention.
Figure 6:
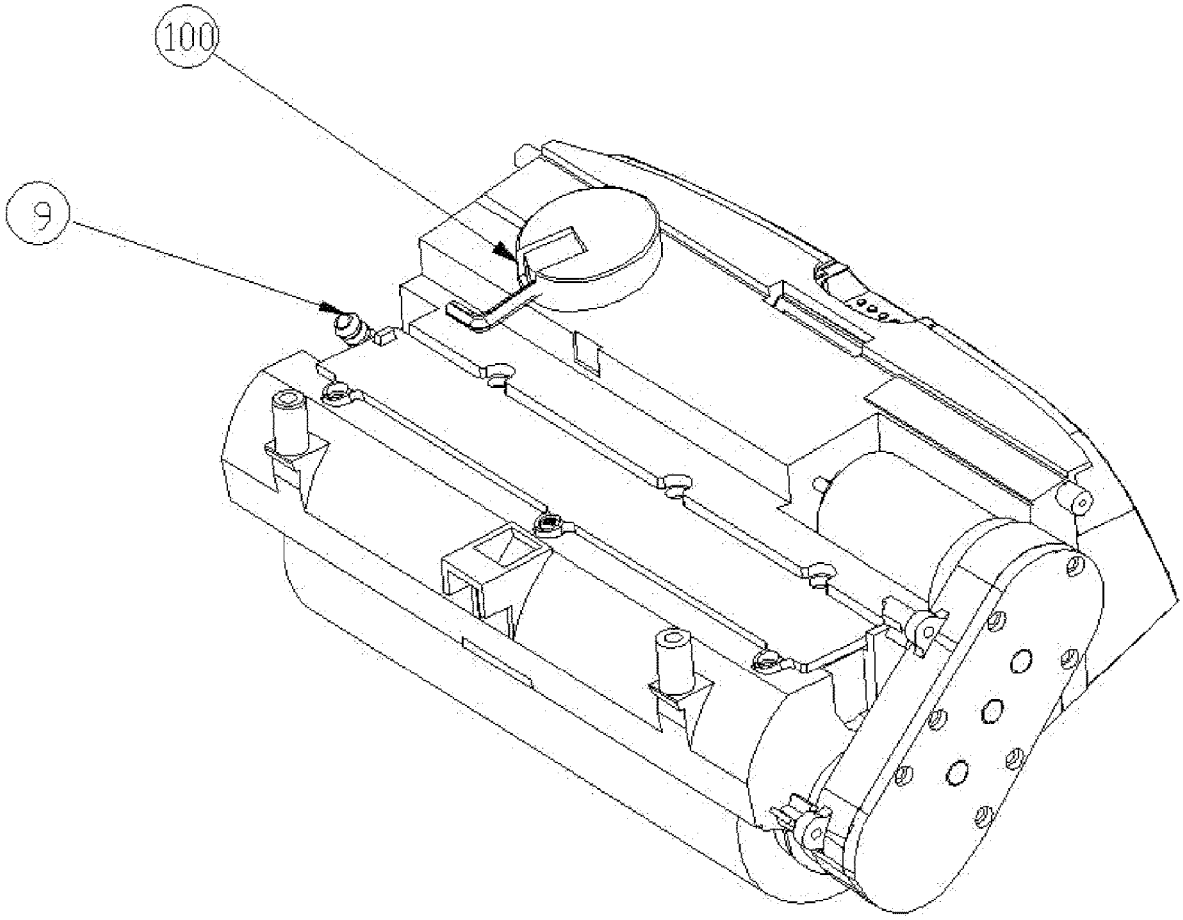
FIG. 6 is a schematic perspective structural view from the front side of the cleaning apparatus for a cleaner robot according to an embodiment of the invention

Referring to FIG. 2, FIG. 2 is actually a schematic exploded view of the invention as viewed from bottom. In the illustrated embodiment, the main body 3 is disposed with a snapping groove 36 corresponding to the sewage sink 6 in size and shape. A part of the sewage sink 6 is snapped into the snapping groove 36, and another part of the sewage sink 6 is snapped into the sewage tank 7. The sewage tank 7 is formed with a sewage tank snapping groove 71, and the another part of the sewage sink 6 is snapped into the sewage tank snapping groove 71.

In the embodiment, when the sweeping roller 1 rotates anticlockwise, the water squeezing rod 2 starts to squeeze the rag on the sweeping roller 1, the water squeezing rod 2 squeezes into 90% of the thickness of the rag, and the sewage squeezed out of the rag flows into the sewage sink 6. The sweeping roller 1 continuously rotates, and the water squeezing stick 2 abuts against the sweeping roller 1, so that the rag will be continuously squeezed, and the excess sewage in the rag will fall into the sewage sink 6, the water in the sewage sink 6 is then introduced into the sewage tank 7 through the second water pump 61.

The invention solves the problem of collecting particle garbage, dust and sewage generated during sweeping the floor, and the article garbage, dust and sewage are collected to relevant sewage sink and sewage tank, so as to achieve the function of automatically cleaning the rag, it does not need to manually clean the rag, compared with the prior art that the rag needs to be cleaned once when it is used once, the rag will be cleaned once after being used 10 times or longer, which greatly saves the user's time.

The above are only preferred embodiments of the invention, and does not limit the patent protection scope of the invention. On the premise of not departing from the spirit and scope of the invention, the invention will have various modification and improvements. Under the inventive concept of the invention, equivalent structural transformations made by using the description and the attached drawings of the invention, or direct/indirect application in other related technical fields are all included in the scope of patent protection of the invention.

What is claimed is:

1. A cleaning apparatus for a cleaner robot, comprising a main body and an accommodation cavity being formed inside the main body; characterized in that:

the cleaning apparatus comprises a water spraying device and a sweeping roller, the water spraying device is disposed in the accommodation cavity and detachably connected with the accommodation cavity, the sweeping roller is disposed in the accommodation cavity and detachably connected with the accommodation cavity, and the water spraying device comprises a water spraying pipe facing towards the sweeping roller;

a water squeezing rod is arranged between the sweeping roller and the accommodation cavity and detachably connected with the accommodation cavity, the water squeezing rod abuts against the sweeping roller, the main body is disposed with a sewage recovery device, and the sewage recovery device is detachably connected with the main body;

a scraping device is disposed between the water spraying device and the sweeping roller and arranged in the accommodation cavity;

the sewage recovery device comprises a sewage sink disposed at an inner side of the sweeping roller, and the sewage sink abuts against the inner side of the sweeping roller;

the main body is further disposed with a driving device for driving the sweeping roller to rotate;

the water squeezing rod, the scraping device and the sewage sink all abut against the same sweeping roller; and the water spraying device further comprises a connection water pipe disposed in the accommodation cavity and connected to the water spraying pipe, and the connection water pipe is disposed between the water squeezing rod and the scraping device.

2. The cleaning apparatus for a cleaner robot as claimed in claim 1, characterized in that the sweeping roller is disposed with a rag capable of absorbing or storing water.

3. The cleaning apparatus for a cleaner robot as claimed in claim 1, characterized in that the scraping device is a scraping plate with a comb-shaped structure.

4. The cleaning apparatus for a cleaner robot as claimed in claim 3, characterized in that the water squeezing rod is configured to squeeze a rag on the sweeping roller; the scraping plate and the rag on the sweeping roller are relatively movable to clean up sundries and garbage from the rag.

5. The cleaning apparatus for a cleaner robot as claimed in claim 1, characterized in that the sewage recovery device further comprises a sewage tank, the sewage sink is disposed with a second water pump and a second connection water pipe, the sewage tank is detachably connected with the sewage sink, and the second water pump is connected to the sewage sink through the second connection water pipe.

6. The cleaning apparatus for a cleaner robot as claimed in claim 5, characterized in that the main body is formed with a snapping groove corresponding to the sewage sink in size and shape, a part of the sewage sink is snapped into the snapping groove, and another part of the sewage sink is snapped into the sewage tank.

7. The cleaning apparatus for a cleaner robot as claimed in claim 1, characterized in that the driving device comprises a motor gear box, and the motor gear box is connected with the sweeping roller.

8. The cleaning apparatus for a cleaner robot as claimed in claim 7, characterized in that a lateral side of the main body is formed with a through hole, the motor gear box comprises a motor, a receiving groove corresponding to the motor in size is disposed at a side of the water spraying device, the motor is disposed in the receiving groove, and the motor gear box passes through the through hole and connects to the sweeping roller.

9. The cleaning apparatus for a cleaner robot as claimed in claim 1, characterized in that the scraping device is located between the water squeezing rod and the sewage sink along a rotation direction of the sweeping roller.

10. The cleaning apparatus for a cleaner robot as claimed in claim 1, wherein the sewage recovery device further comprises a sewage tank detachably connected with the sewage sink, the main body is provided with a snapping groove, a part of the sewage sink is snapped into the snapping groove, the sewage tank is provided with a sewage tank snapping groove, and another part of the sewage sink is snapped into the sewage tank snapping groove.

11. The cleaning apparatus for a cleaner robot as claimed in claim 10, wherein the water spraying pipe is disposed on an end of the connection water pipe, and is perpendicular to a length direction of the connection water pipe.

12. The cleaning apparatus for a cleaner robot as claimed in claim 11, wherein the sewage sink is disposed with a second water pump and a second connection water pipe, the second water pump is connected to the sewage sink through the second connection water pipe, and the sewage tank is provided with a groove for holding the second water pump.

13. A cleaning apparatus for a cleaner robot, comprising:

a main body with an accommodation cavity formed inside the main body;

a sweeping roller, disposed in the accommodation cavity;

a water spraying device, disposed in the accommodation cavity, wherein the water spraying device comprises a water spraying pipe facing towards the sweeping roller and a connection water pipe disposed in the accommodation cavity and connected to the water spraying pipe;

a water squeezing rod, disposed in the accommodation cavity, wherein the water squeezing rod abuts against the sweeping roller;

a scraping device, disposed in the accommodation cavity, wherein the scraping device abuts against the sweeping roller, and the connection water pipe is disposed between the water squeezing rod and the scraping device;

a sewage recovery device, detachably connected with the main body, wherein the sewage recovery device comprises a sewage sink disposed at an inner side of the sweeping roller, the sewage sink abuts against the inner side of the sweeping roller and thereby the water squeezing rod, the scraping device and the sewage sink all abut against the same sweeping roller; and the water squeezing rod, the scraping device and the sewage sink are sequentially arranged in that order along a rotation direction of the sweeping roller; and a driving device, disposed on the main body and configured to drive the sweeping roller to rotate.

14. The cleaning apparatus for a cleaner robot as claimed in claim 13, wherein the scraping device is a scraping plate with a comb-shaped structure, the sweeping roller is disposed thereon a rag capable of absorbing or storing water, the water squeezing rod is configured to squeeze the rag on the sweeping roller and thereby water in the rag on the sweeping roller is squeezed out and the water being squeezed out flows downwards into the sewage sink, and the scraping plate and the rag on the sweeping roller are relatively movable to clean up sundries and garbage from the rag.

15. The cleaning apparatus for a cleaner robot as claimed in claim 13, wherein the sewage recovery device further comprises a sewage tank detachably connected with the sewage sink, the main body is provided with a snapping groove, a part of the sewage sink is snapped into the snapping groove, the sewage tank is provided with a sewage tank snapping groove, and another part of the sewage sink is snapped into the sewage tank snapping groove.

16. The cleaning apparatus for a cleaner robot as claimed in claim 15, wherein the water spraying pipe is disposed on an end of the connection water pipe, and is perpendicular to a length direction of the connection water pipe.

17. The cleaning apparatus for a cleaner robot as claimed in claim 16, wherein the sewage sink is disposed with a second water pump and a second connection water pipe, the second water pump is connected to the sewage sink through the second connection water pipe, and the sewage tank is provided with a groove for holding the second water pump.

* * * * *